United States Patent [19]

Ishikawa et al.

[11] Patent Number: 5,069,148

[45] Date of Patent: Dec. 3, 1991

[54] TROUSER-FLY PIECE SERGING APPARATUS

[75] Inventors: Kiichirou Ishikawa; Yasuhiro Fukumoto; Chet Dudek, all of Marietta, Ga.

[73] Assignee: Yoshida Kogyo K. K., Tokyo, Japan

[21] Appl. No.: 578,669

[22] Filed: Sep. 7, 1990

[51] Int. Cl.[5] ..... D05B 3/12; D05B 3/22; D05B 37/00

[52] U.S. Cl. ..... 112/104; 112/113; 112/153; 112/306; 112/122

[58] Field of Search ..... 112/265.2, 104, 113, 112/121.27, 122, 129, 136, 153, 306

[56] References Cited

U.S. PATENT DOCUMENTS

| | | | |
|---|---|---|---|
| 1,136,846 | 4/1915 | Thompson | 112/129 X |
| 3,204,591 | 9/1965 | Pickett | 112/136 X |
| 3,570,104 | 3/1971 | Jenson . | |
| 3,919,942 | 11/1975 | Galya et al. . | |
| 3,970,017 | 7/1976 | Babson et al. | 112/153 X |
| 3,973,507 | 8/1976 | Sambus | 112/136 |
| 4,075,957 | 2/1978 | Marforio | 112/153 |
| 4,152,996 | 5/1979 | Van Amburg . | |
| 4,236,292 | 12/1980 | Orr et al. . | |
| 4,333,232 | 6/1982 | Orr et al. . | |
| 4,362,116 | 12/1982 | Sen Gupta et al. . | |
| 4,594,925 | 6/1986 | Ishikawa . | |
| 4,611,546 | 9/1986 | Miyakawa . | |
| 4,685,408 | 8/1987 | Frye | 112/122 X |
| 4,722,290 | 2/1988 | Manuel et al. | 112/153 |
| 4,846,087 | 7/1989 | Hinckle | 112/265.2 X |

FOREIGN PATENT DOCUMENTS

| | | |
|---|---|---|
| 63-226394 | 9/1988 | Japan . |
| 1-101493 | 7/1989 | Japan . |

*Primary Examiner*—Werner H. Schroeder
*Assistant Examiner*—Paul C. Lewis
*Attorney, Agent, or Firm*—Hill, Van Santen, Steadman & Simpson

[57] ABSTRACT

A trouser-fly piece serging apparatus includes a guide unit disposed upstream of a serging station and composed of a first elongate guide member extending at an angle relative to the path of movement of a trouser-fly piece being advanced by a serging unit, and a second elongate guide member extending parallel to the path of movement of the trouser-fly piece. The trouser-fly piece is guided by the first guide member into the serging station so that a trimming cutter disposed immediately upstream of the serging unit assumes a position to conform to a curvature of the leading end of a substantially arcuate trimming line passing across a corner of the leading end of the trouser-fly piece. Synchronous operation of the serging unit and the trimming cutter causes the trouser-fly piece to turn in one direction during which an arcuate corner which is trimmed by the trimming cutter and subsequently serged by the serging unit is automatically produced on the leading end of the trouser-fly piece. Then, the trouser-fly piece is guided by the second guide member, and as the trouser-fly piece is further advanced, a curved longitudinal edge of the trouser-fly piece including the trimmed arcuate corner is completely serged with an overedge or serge stitching.

9 Claims, 4 Drawing Sheets

TROUSER-FLY PIECE SERGING APPARATUS

BACKGROUND OF THE INVENTION

1. Field of the Invention

The present invention relates generally to trouser-fly piece serging machines, and more particularly to an apparatus for serging a trouser-fly piece along its curved one longitudinal edge while forming the curved longitudinal edge by trimming at least a corner of the leading end of the trouser-fly piece substantially arcuately.

2. Description of the Prior Art

In general, trouser-fly pieces, as shown in FIG. 6, have a substantially arcuate corner at one end thereof which is trimmed to make a pair of trouser's appear sightly and not to provide a sense of discomfort for the wearer. In a sewing shop for mass-producing trousers, a continuous elongate fabric which is the same as the fabric of the trousers is folded zigzag along the length thereof and subsequently, the fanfolded elongate fabric is severed at opposite folded ends, thus forming a number of trouser-fly pieces at one time. However, since the trouser-fly pieces thus severed are stacked in alternating front-to-front and back-to-back confrontation to one another, an additional process is needed to overturn every other trouser-fly piece prior to the corner trimming process stated above.

With the forgoing difficulty in view, according to a known practice, trouser-fly pieces of an elongate rectangular shape are severed one at a time from a continuous elongate fabric. Then, the individual trouser-fly pieces are manually supplied to a serging machine having a trimming cutter. In this instance, each trouser-fly piece while being gripped by the operator is manually turned as it is advanced through a serging station of the serging machine, so that a corner of the leading end of the trouser-fly piece is trimmed into a substantially arcuate shape. Substantially at the same time, one longitudinal edge of the trouser-fly piece including the trimmed arcuate corner is serged with an overedge or serge stitching to avoid raveling. The known serging practice including manual turning of the trouser-fly piece is tedious and time-consuming, requires a great deal of skill and considerably lowers the serging efficiency. Furthermore, the trimmed arcuate corner is irregular in shape.

Trouser-fly pieces used in the serging operation shown in U.S. Pat. No. 4,152,996 have a substantially arcuate corner at the leading end as they are previously trimmed along one longitudinal edge. As each of the trouser-fly pieces is advanced toward a serging station, the curved longitudinal edge including the arcuate corner is gradually pulled toward the opposite straight edge to form a longitudinal pucker or fold of an inverted U-shape. The fold is maintained until the trailing end of the trouser-fly piece passes through the serging station. With this transverse pulling of the curved longitudinal edge, a line of overedge or serge stitches can be formed on the curved longitudinal edge. However, owing to this transverse pulling process, the known serging machine cannot operate at high speeds. Furthermore, depending upon the material and thickness of a fabric forming the trouser-fly piece, the transverse pulling may be performed inaccurately with the result that an overedge or serge stitching does not conform to the shape of the curved longitudinal edge and makes the trouser-fly piece appear unsightly.

SUMMARY OF THE INVENTION

With the foregoing difficulties of the prior art in view, it is an object of the present invention to provide an apparatus for automatically serging a trouser-fly piece along its curved one longitudinal edge while forming the curved longitudinal edge by substantially arcuately trimming at least a corner of the leading end of the trouser-fly piece.

Another object of the present invention is to provide a trouser-fly piece serging apparatus incorporating a guide unit which enables a trimming cutter to accurately trace a substantially arcuate trimming line passing across a corner of the leading end of an elongate rectangular trouser-fly piece.

A further object of the present invention is to provide an apparatus for serging a trouser-fly piece along a curved longitudinal edge a high speeds without being influenced by the material and thickness of a fabric constituting the trouser-fly piece.

A still further object of the present invention is to provide a trouser-fly piece serging apparatus which can be operated without skill.

A trouser-fly piece serging apparatus according to the present invention includes a serging unit defining a serging station for advancing an elongate rectangular trouser-fly piece through the serging station along a longitudinal path for serging curved one longitudinal edge of the trouser-fly piece with a serge stitching during advancing, and a trimming cutter disposed immediately upstream of the serging station and operative in synchronism with the serging unit for trimming at least a corner. of the leading edge of the trouser-fly piece along a substantially arcuate trimming line to form the curved longitudinal edge including the trimmed arcuate corner while the trouser-fly piece is being advanced by the serging unit. A first guide member is disposed upstream of the trimming cutter and has a first guide surface extending at an angle relative to the path of advancement of the trouser-fly piece for guiding the trouser-fly piece into the serging station so that the trimming cutter assumes a position to conform to a curvature of the leading end of the arcuate trimming line. The apparatus further includes a second guide member disposed upstream of the trimming cutter and having a second guide surface extending parallel to the path of advancement of the trouser-fly piece for guiding the curved longitudinal edge of the trouser-fly piece except the trimmed arcuate corner after the trouser-fly piece is guided into the serging station by the first guide member.

With this construction, when the trouser-fly piece is guided by the first guide member to the position of the trimming cutter, the trimming cutter assumes a position to conform to a curvature of the leading edge of an arcuate trimming path passing across a corner of the leading end of the trouser-fly piece. Operation of the serging unit causes the trouser-fly piece to turn in one direction about a portion thereof during which time the trimming cutter accurately traces the arcuate trimming line and while at the same time, the serging unit forms an overedge or serge stitch on the thus trimmed arcuate corner. Subsequently, the trouser-fly piece is guided by the second guide member which extends parallel to the path of movement of the trouser-fly piece being advanced by the serging unit. As the trouser-fly piece is further advanced, a curved longitudinal edge of the trouser-fly piece including the trimmed arcuate corner is serged with the serge stitching.

The above and other objects, features and advantages of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

The present invention will be described hereinbelow in detail with reference to a preferred embodiment shown in the accompanying drawings.

Figure 1:
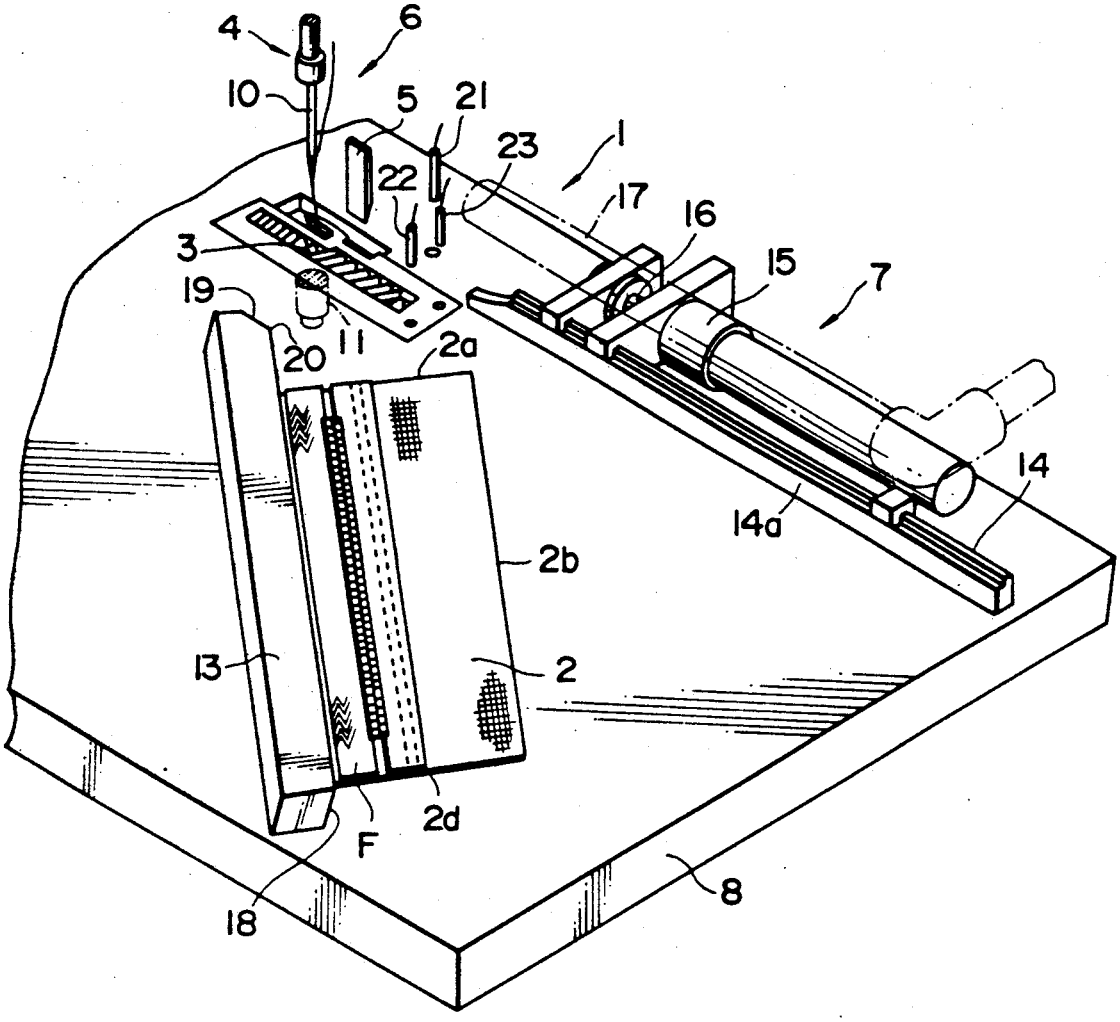
FIG. 1 is a perspective view of a main portion of a trouser-fly piece serging apparatus according to the present invention.
Figure 2:
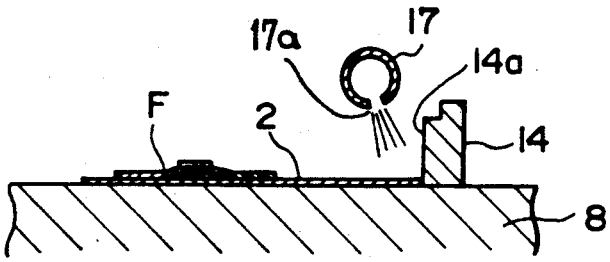
FIG. 2 is an enlarged cross-sectional view of a fly piece as it is guided by a second guide member of the apparatus.

As shown in FIG. 1, a trouser-fly piece serging apparatus 1 according to the present invention includes a serging unit 4 defining a serging station 6 for serging one longitudinal edge of a trouser-fly piece 2 as the trouser-fly piece 2 is advanced through the serging station 6 along a longitudinal path, a trimming cutter 5 for forming a curved longitudinal edge 2*b'* (FIG. 5) to be serged, and a trouser-fly piece guide unit 7 disposed upstream of the serging station 6 for guiding a trouser-fly piece 2 as it is supplied to and advanced through the serging station 6. The serging unit 4, the trimming cutter 5 and the guide unit 7 are disposed on a table 8.

The serging unit 4 is a conventional serging machine which includes a serge stitch forming mechanism having a needle 10 for forming an overedge or serge stitching 9 (FIG. 5) on one longitudinal edge of a trouser-fly piece 2. The serging unit 4 further includes a feed dog 3 disposed in the table 8 beneath the needle 10. The feed dog 3 cooperates with a presser foot (not shown) to advance the trouser-fly piece 2 through the serging station 6 in timed relation to the operation of the serge stitch forming mechanism. Other component parts of the serge stitch forming mechanism are omitted for clarity.

The trimming cutter 5 is disposed immediately upstream of the serging station 6 for trimming at least a corner of the leading end 2*a* of the trouser-fly piece 2 being advanced into the serging station 6. The trimming cutter may be arranged to trim the trouser-fly piece 2 along one longitudinal edge 2*b* additional to the trimming of the corner. The trimming cutter 5 is vertically reciprocated by a suitable drive means (not shown) in synchronism with the reciprocating movement of the needle 10.

A cylindrical auxiliary presser member 11 is disposed close to and upstream of the serging unit 4 and vertically movable toward and away from the table 8 for forcing a portion of the trouser-fly piece 2 against the table 8 to cause the trouser-fly piece 2 to turn in one direction about the same portion, as described later.

The serging unit 4, the trimming cutter 5 and the auxiliary presser member 11 are all available in the market.

The guide unit 7 includes an elongate first guide member 13 for guiding the trouser-fly piece 2 toward the serging station 6 with the leading end 2*a* of the trouser-fly piece 2 facing to the trimming cutter 5. The first guide member 13 has a guide surface 18 extending at an angle relative to the path of movement of the trouser-fly piece 2 being advanced by the serge unit 4, for guiding the trouser-fly piece 2 into the serge station 6 so that the trimming cutter 5 assumes a position to conform to a curvature of the leading end of a substantially arcuate trimming line 12 (illustrated by the phantom lines in FIG. 4) passing across a corner of the leading end of the trouser-fly piece 2. The guide unit 7 further includes an elongate second guide member 14 engageable with the curved longitudinal edge 2*b'* of the trouser-fly piece 2 except the trimmed arcuate corner for guiding the trouser-fly piece 2 toward the serging station 6. The second guide member 14 has a guide surface 14*a* extending parallel to the path of movement of the trouser-fly piece 2 being advanced by the serging unit 4. The first guide member 13 is fixedly mounted on the table 8 but preferably it is adjustable in position relative to the second guide member 14 so as to accommodate various trouser-fly pieces of different widths. The second guide member 14 is also mounted on the table 8. For reliable guidance of the trouser-fly piece 2, it is preferable that one end of the second guide member 14 is located close to the serging station 6. However, such close positioning of the second guide member 14 is not always possible for a reason described below, so the second guide member 14, preferably, is reciprocally movably mounted on the table 8. To this end, a fluid-pressure actuator such as an air cylinder 15 extending parallel to the second guide member 14 is mounted on the table 8 with its piston rod 16 connected to the second guide member 14. With this arrangement, the second guide member 14 is movable toward and away from the serging station 6 in response to the operation of the air cylinder 15.

The serging apparatus 1 further includes an air ejecting pipe 17 disposed above the second guide member 14 and extending alongside the second guide member 14 for ejecting compressed air against the front surface of the trouser-fly piece 2 being advanced so as to prevent the trouser-fly piece 2 from becoming puckered or wavy. The air ejection pipe 17 has a longitudinal slit or nozzle 17*a* opening downwardly and obliquely toward a corner defined between the guide surface 14*a* of the second guide member 14 and the table 8, so that a longitudinal portion of the trouser-fly piece 2 which is located adjacent to the second guide member 14 is pneumatically depressed against the table 8. With the air ejecting pipe 17 thus provided, the trouser-fly piece 2 is held in a slat state while it is guided by the second guide member 14.

The guide surface 18 of the first guide member 13 guides a straight longitudinal edge 2*c* (FIG. 4) of the trouser-fly piece 2 which is opposite to the curved longitudinal edge 2*b'* adapted to be guided by the second guide member 14. The leading ends of the first and second guide members 13, 14 are spaced apart by a distance which is slightly larger than the width of the trouser-fly piece 2 so as to permit the trouser-fly piece 2 to pass smoothly between the first and second guide members 13, 14. An inner corner of the leading end of the first guide member 13 is beveled to form an auxiliary guide surface 19 which is contiguous to a leading end of the guide surface 18 and extends parallel to the second guide member 14. The auxiliary guide surface 19 is spaced from the guide surface 14*a* of the second guide member 14 by a distance substantially the equal to or slightly larger than the width of the trouser-fly piece 2. The auxiliary guide surface 19 and the guide surface 18 of the first guide member 13 jointly define a corner 20. The corner 20 serves as a fulcrum about which the trouser-fly piece 2 turns when it is advanced for the formation of the trimmed arcuate corner of the trouser-fly piece 2 and the serge stitching 9 on the trimmed arcuate corner. The corner 20 is disposed upstream of the serging station 6.

Figure 3A:
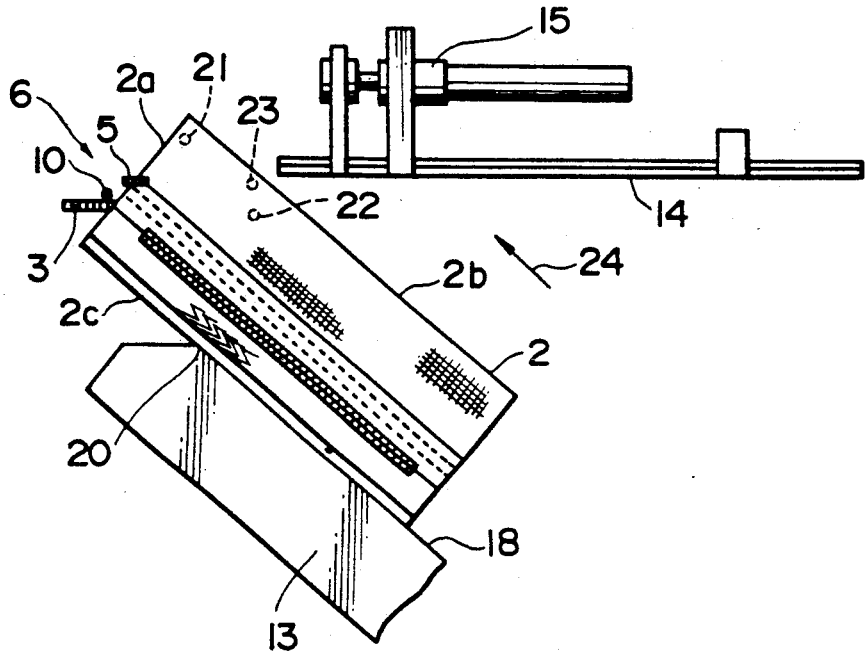
FIGS. 3(A) through 3(D) are schematic plan views showing the sequence of steps of operation of the apparatus.

Three photodetectors 21, 22, 23 are disposed between the serging station 6 and the guide unit 7. Each of the photodetectors 21–23 is composed of a light source disposed above the table 8 and a photosensitive device disposed below the table in alignment with the light source. The first photodetector 21 is disposed diagonally to the upstream right of the trimming cutter 5 and the serging station 4 for detecting the leading end 2*a* of the trouser-fly piece 2 being advanced into the serging station 6 as shown in FIG. 3(A). Upon detection of the leading end 2*a*, the first photodetector 21 sends an electric signal to a controller (not shown) of the serge stitch forming mechanism to start operation of the serging unit 4 and the trimming cutter 5 in synchronism with each other. The trimming cutter 5 thus activated trims a corner of the leading end 2*a* along the substantially arcuate trimming line 12 (FIG. 4), thereby forming a curved longitudinal edge 2*b*′ of the trouser-fly piece 2, while at the same time, the serging unit 4 forms an overedge or serge stitching 9 (FIG. 5) on the curved longitudinal edge 2*b*′. During that time, the feed dog 3 cooperates with the non-illustrated presser foot to advance the trouser-fly piece 2 through the serging station 6.

The second photodetector 22 is disposed directly upstream of the serging station 6 for detecting the trailing end 2*d* of the trouser-fly piece 2 being advanced along the second guide member 14. Upon detection of the trailing end 2*d*, the second photodetector 22 sends an electric signal to the non-illustrated controller to thereby stop operation of the serge unit 4 and the trimming cutter 5. Since the second photodetector 22 is spaced from the serging station 6 disposed beneath the needle 10, the operation of the serging unit 4 and the trimming cutter 6 must continue for a certain period of time after detection of the trailing end 2*d* of the trouser-fly piece 2 by the second photodetector 22. The controller includes a delay counter (not shown) for setting the number of cycles of vertical reciprocation of the needle 10 which is needed to continue operation of the serging unit 4 and the trimming unit 5 for the certain time period after detection of the trailing end 2*d* of the trouser-fly piece 2. When the trailing end 2*d* of the trouser-fly piece 2 is detected by the second photodetector 22, the delay counter is activated to count the number of cycles of vertical reciprocation of the needle 10, and when the number of counted cycles of vertical reciprocation of the needle 10 is equal to the preset value, the delay counter energizes a relay to stop the operation of the needle 10 and the trimming cutter 6. The delay counter may be replaced by a timer.

The third photodetector 23 is disposed upstream of the serging station 6 and operatively connected to a controller of the auxiliary presser member 11 in such a manner that when the trouser-fly piece 2 being advanced into the serging station 6 blocks or interrupts a beam of light coming from the light source to the mating photosensitive device of the third photodetector 23 (when the third photodetector 23 detects the presence of the trouser-fly piece 2), the auxiliary presser member 11 is kept in its uppermost standby position, and when the trouser-fly piece 2 clears a path of light beam in the third photodetector 23 (when the third photodetector 23 detects the absence of the trouser-fly piece 2), the third photodetector 23 sends an electric signal to the controller to lower the auxiliary presser member 11 onto the trouser-fly piece 2.

In the illustrated embodiment, the operation of the various mechanisms are controlled depending upon sensing of the first to third photodetectors 21–23. The invention is not limited to the illustrated arrangement. It is possible according to the invention to omit the first photodetector 21 in which instance the second photodetector 22 is constructed to detect the presence of the trouser-fly piece 2. More specifically, the second photodetector 22 is connected with the controller for the serging unit 4 and the trimming cutter 5 via a timer which provides a certain time delay between the detection of the leading end 2*a* of the trouser-fly piece 2 by the second photodetector 22 and activation of the serging unit 4 and the trimming cutter 5. By properly setting the timer, the serging unit 4 and the trimming cutter 5 are activated when the leading end 2 of the trouser-fly piece 2 arrives at the trimming cutter 5. As an alternative, four or more photodetectors or sensors may be provided to the reliability of interlocking between the operation of the various driving mechanisms and the condition of the trouser-fly piece 2 being guided into the serging station 6.

Operation of the trouser-fly piece serging apparatus 1 of the foregoing construction will be described below with reference to FIGS. 3(A) through 3(D).

Figure 4:
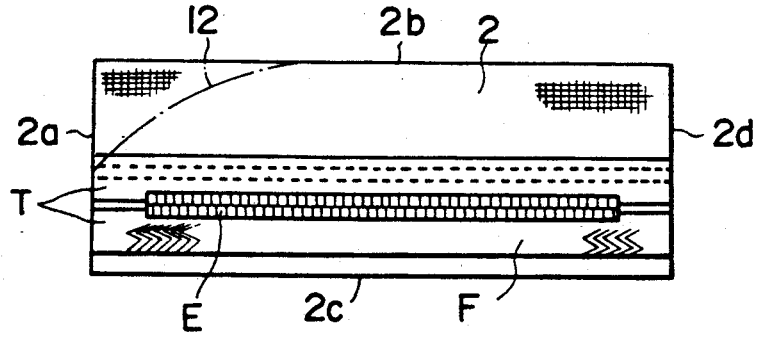
FIG. 4 is a plan view of a trouser-fly piece before it is processed on the apparatus.
Figure 6:
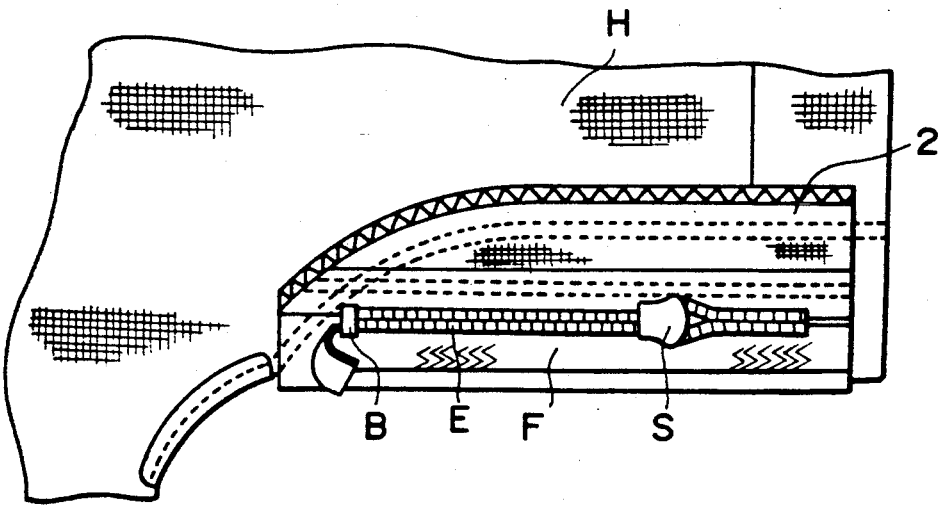
FIG. 6 is a fragmentary plan view of a trouser-fly piece as it is attached to the front of a pair of trousers.

A trouser-fly piece 2 to be processed on the apparatus 1, as shown in FIG. 4, has an elongate rectangular shape and is severed from a fabric which is the same as the fabric of a pair of trousers to which the fly piece 2 is attached. A slide fastener stringer F including a pair of stringer tapes T with respective rows of coupling elements E mounted on the inner longitudinal edges thereof is sewn to the trouser-fly piece 2 by a pair of straight lines of stitches (not designated). In this condition, a slider S and a bottom end stop B are not provided on the slide fastener stringer F. They are attached after the fly piece 2 is sewn to the front H of a pair of trousers, as shown in FIG. 6. The trouser-fly piece serging apparatus 1 of the invention can be used with a trouser-fly piece 2 devoid of a slide fastener stringer F. In this instance, a slide fastener assembly is attached to a trouser-fly piece 2 which has been processed on the apparatus 1 of the invention.

As shown in FIG. 1, an elongate rectangular trouser-fly piece 2 is disposed flatwise on the table 8 and then manually guided longitudinally along the guide surface 18 of the first guide member 13 with the leading end 2*a* facing toward the serging station 6. The trouser-fly piece 2 guided by the guide surface 18 extends along an inclined path extending at an angle relative to the path of movement of the trouser-fly piece 2 being advanced by the serging unit 4. The angle of inclination is determined such that when the trouser-fly piece 2 is guided into a path of movement of the trimming cutter 5, the trimming cutter 5 assumes a position to conform to a curvature of the leading end of a substantially arcuate cutting line 12 (FIG. 4) passing across a corner of the leading end 2a of the trouser-fly piece 2. Then, the trouser-fly piece 2 is advanced longitudinally along the guide surface 18 of the first guide member 13 in the direction indicated by the arrow 24 in FIG. 3(A). In this instance, the second guide member 14 is disposed in a retracted position in which the leading end of the second guide member 14 is separated upstream from the serging station 6 until it clears the leading end 2a of the trouser-fly piece 2 being advanced toward the serging station 6. A leading end portion of the trouser-fly piece 2 is disposed above a part of the feed dog 3 and the leading end 2a of the trouser-fly piece 2 is detected by the first photodetector 21, as shown in FIG. 3(A), whereupon the first photodetector 21 issues an electric signal to start operation of the serging unit 4 and the trimming cutter 5. The feed dog 3 cooperating with the non-illustrated presser foot automatically advances the trouser-fly piece 2 toward the serging station 6. Thereafter, the trimming cutter 5 trims a corner of the leading end 2a of the trouser-fly piece 2 along the substantially arcuate trimming line 12 (FIG. 4), thereby forming a curved longitudinal edge 2b' of the trouser-fly piece 2 including the trimmed substantially arcuate corner. Substantially at the same time, the serging unit 4 forms an overedge or serge stitching 9 (FIG. 5) on the curved longitudinal edge 2b.

Figure 3B:
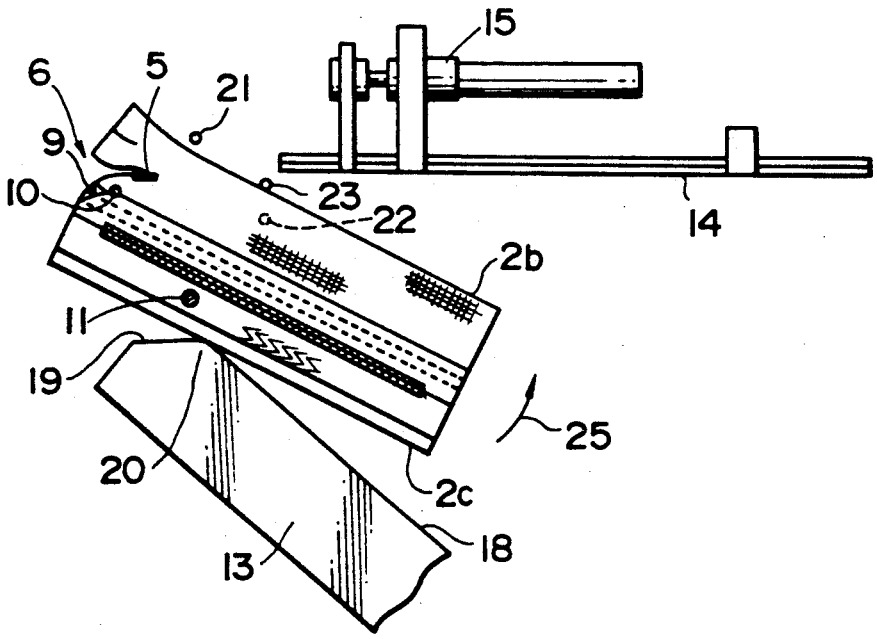

During that time, since the corner 20 defined on the leading end of the first guide member 13 is disposed upstream of the feed dog 3 of the serging unit 4, the trouser-fly piece 2 being advanced by coaction between the feed dog 3 and the presser foot tends to turn about the corner 20 in the counterclockwise direction as indicated by the arrow 25 in FIG. 3(B). With this rotational movement of the trouser-fly piece 2, the trimming cutter 5 accurately traces the substantially arcuate trimming line 12 (FIG. 4). If the longitudinal edge 2a of the trouser-fly piece 2 while being rotated exposes the third photodetector 23 and hence the third photodetector 23 detects the absence of the trouser-fly piece 2, this means that such rotational movement of the trouser-fly piece is improper. Thus, upon detection of the absence of the trouser-fly piece 2, the third photodetector 23 issues an electric signal to lower the cylindrical auxiliary presser member 11 onto the trouser-fly piece 2 being processed. Since the auxiliary presser member 11 forces a portion of the trouser-fly piece 2 against the table 8, and since the forced fly piece portion is laterally offset from the direction of movement of the trouser-fly piece 2 toward the first guide member 13, as shown in FIG. 3(B), the trouser-fly piece 2 while being fed is positively turned about the auxiliary presser member 11 in the direction of the arrow 25. In this instance, the auxiliary presser member 11 serves as means for causing the trouser-fly piece 2 to turn in one direction and hence to produce an angular moment acting in the direction of the arrow 25 about the auxiliary presser member 11.

Figure 3C:
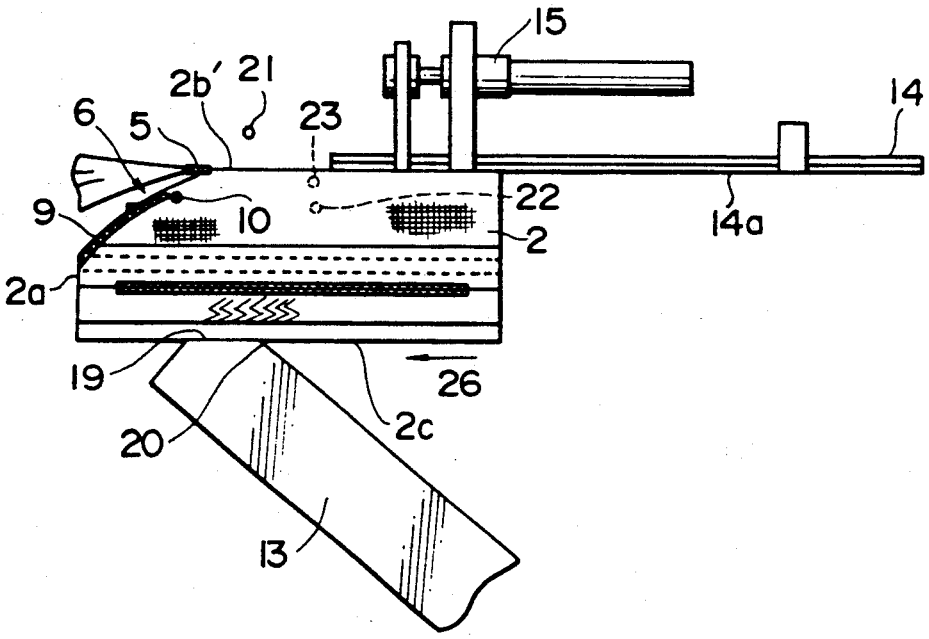

When a predetermined rotational movement of the trouser-fly piece 2 is completed, the trouser-fly piece 2 completely separates from the first guide member 13 and is held into guided engagement with the second guide member 14, as shown in FIG. 3(C). In this instance, the position of the third photodetector 23 is covered with the trouser-fly piece 2 whereupon the third photodetector 23 issues an electric signal to return the auxiliary presser member 11 to its uppermost standby position. Continuing operation of the feed dog 3 causes the trouser-fly piece 2 to advance in the direction of the arrow 26 through the serging station 6 with its curved longitudinal edge 2b' guided by the guide surface 14a of the second guide member 14. Thus, a portion of the curved longitudinal edge 2b' which is contiguous to the trimmed arcuate corner is serged with the serge stitching 9. During that time, a straight opposite longitudinal edge 2c of the trouser-fly piece 2 is guided by the auxiliary guide surface 19 on the leading end of the first guide member 13. The trouser-fly piece 2 can, therefore, be guided stably and reliably without transverse displacement. Furthermore, the air ejecting pipe 17 ejects compressed air onto the trouser-fly piece 2, thereby forcing the latter flatwise against the table 8. Thus, the trouser-fly piece 2 is prevented from becoming puckered or wavy during the course of its advancement through the serging station 6.

Figure 3D:
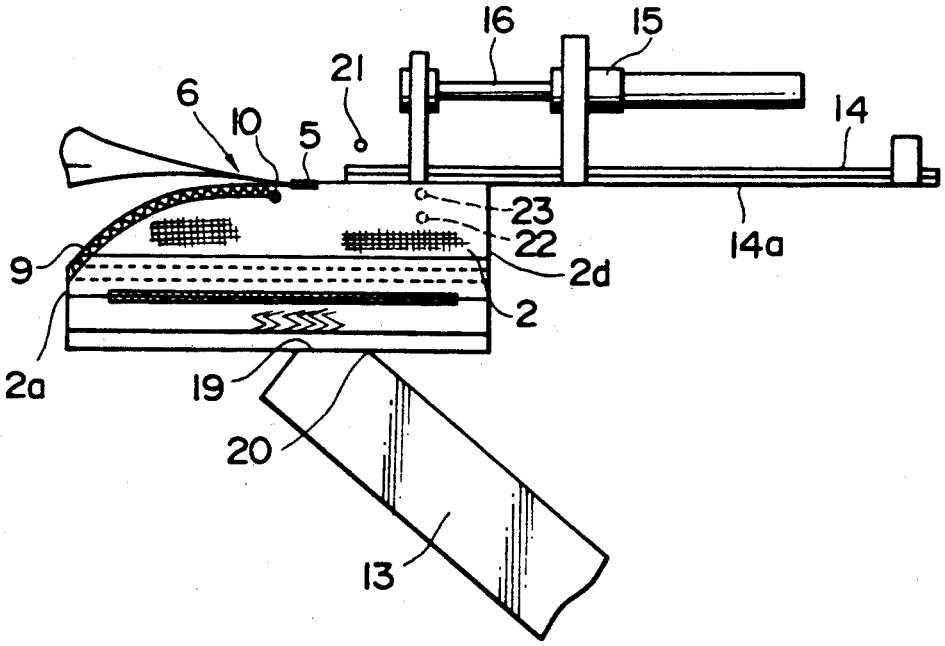

Thereafter, the air cylinder 15 is activated to extend its piston rod 16, thereby advancing the second guide member 14 toward the serging station 6 until the leading end of the second guide member 14 is located close to the serging station 6, as shown in FIG. 3(D). With the second guide member 14 thus advanced, the trouser-fly piece 2 and its trailing end portion, in particular, can be guided accurately and stably into the serging station 6.

Figure 5:
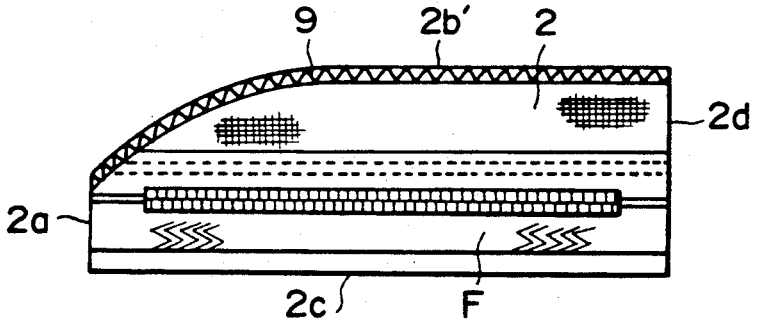
FIG. 5 is a plan view of the trouser-fly piece after it is processed on the apparatus.

A further advancing movement of the trouser-fly pieces 2 causes the trailing end 2d to arrive at the position of the second photodetector 22 whereupon the second photodetector 22 issues an electric signal to activate or start the non-illustrated delay counter. Operation of the trimming cutter 4 and the serging unit 4 further continues until the number of cycles of reciprocation of the needle 10 counted by the delay counter is in equal to the preset value. During that time, the curved longitudinal edge 2b' of the trouser-fly piece 2 is serged with the serge stitching 9 along the entire length thereof. Subsequently, the delay counter issues an electric signal to stop operation of the serge unit 4 and the trimming cutter 5. Thus, a trouser-fly piece 2 with its curved longitudinal edge 2b' serged with the serge stitching 9 is produced, as shown in FIG. 5. Then, the next trouser-fly piece is supplied to the guide unit 7 and the foregoing sequence of steps of operation is repeated until a desired number of serged trouser-fly pieces are obtained.

The air ejecting pipe 17, preferably, extends to a position adjacent to the second and third photodetectors 22, 23 to insure a reliable positioning of the trouser-fly piece 2 relative to the respective photodetectors 22, 23 which will results in reliable sensing of various conditions of the trouser-fly piece 1 by the photodetectors 22, 23.

As described above, an elongate rectangular trouser-fly piece is advanced toward a serging station of the apparatus while it is being guided by a guide unit composed of first and second elongate guide members. Since the first guide member extends at an angle relative to the path of movement of the trouser-fly piece being advanced by a serging unit, the trouser-fly piece guided by this first guide member into the serging station so that a trimming cutter assumes a position to conform to a curvature of the leading end of a substantially arcuate trimming line passing across a corner of the leading end of the trouser-fly piece. The trouser-fly piece as it is advanced by the serging unit is turned in one direction during which time the trimming cutter accurately traces the arcuate trimming line and substantially at the same time, an overedge or serge stitch is formed by the serging unit on the thus trimmed arcuate corner. Subsequently, the trouser-fly piece is guided by the second guide member extending parallel to the path of movement of the trouser-fly piece being advanced by the serging unit. As operation of the serging unit continues, a curved longitudinal edge of the trouser-fly piece including the trimmed arcuate corner is serged with the serge stitching. Since the turning of the trouser-fly piece is achieved automatically by mechanical means, the trimmed arcuate corner is uniform in shape. Thus, the serging apparatus of the invention can be operated without skill, produces serged trouser-fly pieces at an increased rate of production and is suited for the mass production.

Obviously, various modifications and variations of the present invention are possible in the light of the above teaching. It is therefore to be understood that within the scope of the appended claims the invention may be practiced otherwise than as specifically described.

What is claimed is:

1. An apparatus for trimming at least a corner of a leading end of an elongate rectangular trouser-fly piece along a substantially arcuate trimming line and substantially at the same time for forming a serge stitching on one longitudinal edge of the trouser-fly piece including the trimmed arcuate corner, said apparatus comprising:

a serging unit defining a serging station for advancing the elongate rectangular trouser-fly piece longitudinally along a path to move through the serging station and for serging one curved longitudinal edge of the trouser-fly piece with the serge stitching during advancing;

a trimming cutter disposed immediately upstream of said serging station and operative in synchronism with said serging unit for trimming at least a corner of the leading edge of the trouser-fly piece along the substantially arcuate trimming line to form the curved longitudinal edge including the trimmed arcuate corner while the trouser-fly piece is being advanced by said serging unit;

a first guide member disposed upstream of said trimming cutter and having a first guide surface extending at such an angle relative to said path of advancement of the trouser-fly piece that the first guide surface and the path of advancement of the trouser-fly piece converge toward the serging station for guiding the trouser fly-piece into said serging station so that said trimming cutter assumes a position to conform to a curvature of the leading end of said arcuate trimming line; and a second guide member disposed upstream of said trimming cutter and having a second guide surface extending parallel to said path of advancement of the trouser-fly piece for guiding said curved longitudinal edge of the trouser-fly piece except said trimmed arcuate corner after the trouser-fly piece is guided into said serging station by said first guide member.

2. An apparatus according to claim 1, further including means disposed upstream of said serging station for causing the trouser-fly piece to turn in a direction to separate the trouser-fly piece from said first guide surface until the trouser-fly piece is guided by said second guide member along said one longitudinal edge.

3. An apparatus according to claim 2, wherein said first guide surface has an end terminating ahead of said serging station, said first guide member having a corner disposed at said end of said first guide surface and engageable with an opposite longitudinal edge of the trouser-fly piece, said corner constituting said causing means.

4. An apparatus according to claim 3, wherein said first guide member further includes an auxiliary guide surface contiguous to said end of said first guide surface and extending parallel to said second guide surface for guiding said opposite longitudinal edge of the trouser-fly piece, said corner being defined by and between said first guide surface and said auxiliary guide surface.

5. An apparatus according to claim 2, wherein said causing means includes a presser member vertically movable toward and away from the trouser-fly piece for temporarily retaining a portion of the trouser-fly piece, said portion offset laterally from said serging station toward said first guide member.

6. An apparatus according to claim 1, wherein said second guide member is reciprocally movable toward and away from said serging station.

7. An apparatus according to claim 6, further including a fluid-pressure actuator operatively connected to said second guide member for reciprocating said second guide member.

8. An apparatus according to claim 1, further including pneumatic means for pneumatically holding the trouser-fly piece in a flat state as the trouser-fly piece is advanced through said serging station.

9. An apparatus according to claim 8, wherein said pneumatic means comprises an air ejecting pipe extending alongside said second guide surface for ejecting compressed air onto a front surface of the trouser-fly piece along a longitudinal portion thereof located adjacent to said second guide surface.

* * * * *